US012042054B2

(12) United States Patent
Yi

(10) Patent No.: US 12,042,054 B2
(45) Date of Patent: Jul. 23, 2024

(54) MULTIFUNCTIONAL OUTDOOR LEISURE ROTARY CHAIR

(71) Applicant: Mingqian Yi, Jianli (CN)

(72) Inventor: Mingqian Yi, Jianli (CN)

( * ) Notice: Subject to any disclaimer, the term of this patent is extended or adjusted under 35 U.S.C. 154(b) by 209 days.

(21) Appl. No.: 17/748,070

(22) Filed: May 19, 2022

(65) Prior Publication Data

US 2022/0273101 A1 Sep. 1, 2022

(51) Int. Cl.
*A47C 3/18* (2006.01)
*A47C 7/00* (2006.01)

(52) U.S. Cl.
CPC ..... *A47C 3/18* (2013.01); *A47C 7/002* (2013.01)

(58) Field of Classification Search
CPC ..... A47C 3/18; A47C 7/002
See application file for complete search history.

(56) References Cited

U.S. PATENT DOCUMENTS 5,765,913 A * 6/1998 LaPointe ..... A47C 1/035 248/370
5,931,530 A * 8/1999 Liu ..... A47C 3/0255 297/344.21
5,947,557 A * 9/1999 Bellefleur ..... A47C 3/0255 297/282
6,241,315 B1 * 6/2001 Chiang ..... A47C 3/0255 297/258.1
7,134,720 B2 * 11/2006 Viger ..... A47C 1/032 297/258.1
7,322,650 B2 * 1/2008 Chouinard ..... A47C 3/0255 297/DIG. 7
7,334,840 B2 * 2/2008 Deans ..... A47C 3/03 297/270.1
8,366,193 B2 * 2/2013 Lin ..... A47C 3/0255 297/270.3
10,820,704 B2 * 11/2020 Sugano ..... A47C 7/02
2003/0015900 A1 * 1/2003 Lu ..... A47C 1/03294 297/259.1
2014/0097658 A1 4/2014 Chen et al.
2019/0142173 A1 5/2019 Saitoh
2020/0229614 A1 7/2020 Schmitz et al.

* cited by examiner

*Primary Examiner* — Philip F Gabler
(74) *Attorney, Agent, or Firm* — Jeenam Park

(57) ABSTRACT

A multifunctional outdoor leisure rotary chair is disclosed in the present invention, which belongs to the technical field of chairs, and includes a rotary base and a supporting frame. After the supporting frame is taken out, each group of rotary bases can be stacked upwards in turn, thus reducing the size of a packaging box during packaging. During transportation, more groups can be stacked without affecting packaging and transportation, thus reducing the cost of packaging materials, reducing the transportation cost, and improving the transportation capacity of the device.

9 Claims, 7 Drawing Sheets

MULTIFUNCTIONAL OUTDOOR LEISURE ROTARY CHAIR

TECHNICAL FIELD

The present invention relates to the field of chair technologies, and more particularly, to a multifunctional outdoor leisure rotary chair.

BACKGROUND

A chair is a kind of daily life furniture, and is a seat with a backrest and armrests. Modern chairs pursue aesthetics and fashion, and some chairs are no longer just used as seats, but make human life more convenient with the combination of science and technology.

The patent No. CN201921135335.9 discloses an armchair, including a support structure, a base structure, a backrest structure, and an armrest structure. The support structure is movably connected to the base structure, the backrest structure is movably connected to the base structure, and the armrest structure has one end movably connected to the support structure and the other end connected to the backrest structure. The armchair further includes a buffer support device arranged on the armrest structure and configured to support the backrest structure. The buffer support device includes a supporting rod, two clamping blocks provided with identical slideways, an elastic member, and two positioning rods respectively arranged in the slideways of the two clamping blocks and configured to stabilize the elastic member. Both ends of the positioning rod are respectively fixedly connected to two side surfaces of the slideway. The elastic member is sleeved on the positioning rod. Both ends of the supporting rod are provided with through holes matching the diameter of the positioning rod. The supporting rod is sleeved on one end of the positioning rod close to the backrest structure through the through holes, and the supporting rod slides on the positioning rod. The elastic member is pressed on a side of the supporting rod away from the backrest structure.

The patent No. CN200720052714.2 discloses a combined chair base structure, including a base supporting column, and a cylindrical cover is arranged on the base supporting column. A concave groove is arranged in the cylindrical cover, and the base supporting column is arranged in the concave groove of the cylindrical cover. Further, an upper cover is arranged at a base central part to which the base supporting column is connected, and the upper cover is made of a plastic material. A mounting hole is arranged at the base central part to which the base supporting column is connected, and the base supporting column is cutting from a metal material. The concave groove at the bottom of the above cylindrical cover is a notch opened on a plane, and a middle part of the base supporting column is provided with a clamping position that protrudes outward.

The armchair in the patent No. CN201921135335.9 solves the problems of a relatively vertical backrest and poor user experience due to that the chair cannot be stable when laid flat. The combined chair base structure in the patent No. CN200720052714.2 has a low cost and solves the problem that electroplating of welding points is not bright enough, which affects the appearance of the chair. However, it cannot solve the problem of a damage to the overall structure of the device caused by inability of bearing the weight as the overall structure is excessively deformed due to the excessive weight, and the problem of affecting packaging and shipping due to the inability of stacking many groups during transportation.

SUMMARY

1. Technical Problems to be Solved

The purpose of the present invention is to provide a multifunctional outdoor leisure rotary chair, so as to address the problems raised in the above background, such as the problem of a damage to the overall structure of the device caused by inability of bearing the weight as the overall structure is excessively deformed due to the excessive weight, and the problem of affecting packaging and shipping due to the inability of stacking many groups during transportation.

2. Technical Solutions

A multifunctional outdoor leisure rotary chair, including a rotary base and a supporting frame, and the supporting frame being mounted at one end of the rotary base, wherein the rotary base includes a ground-contact supporting ring, a rotating mechanism, and an auxiliary lifting mechanism, the rotating mechanism is mounted on an inner end face of the ground-contact supporting ring in an annular array, and the auxiliary lifting mechanism is mounted on a lower end surface of the rotating mechanism.

Preferably, the rotating mechanism includes three groups of supporting inclined columns, a reinforcing block, and a gas pole, the reinforcing block is clamped between the three groups of supporting inclined columns, and the gas pole is mounted on the top of the reinforcing block.

Preferably, the rotating mechanism further includes a carrier sheet, insertion holes, and an insertion ring, a top end of the gas pole is inserted into an inner cavity of the insertion ring, the insertion holes are arranged on the periphery of the carrier sheet, and an inner cavity of the carrier sheet penetrates into an inner cavity wall of the insertion ring. The whole device is placed on the flat ground with the ground-contact supporting ring as a supporting point. The supporting frame is mounted on an upper end surface of the carrier sheet. The carrier sheet rotates with the gas pole as a fulcrum at a rotation angle of 360 degrees.

Preferably, the auxiliary lifting mechanism includes three groups of reinforcing arms, inner connecting rods, a series member, a telescopic cylinder, and a fitting member, inner ends of the three groups of reinforcing arms are all provided with the inner connecting rods mounted thereon, and the other ends of the inner connecting rods are connected to an outer end wall of the series member in an annular array, the series member and the fitting member are movably connected through the telescopic cylinder, and inner cavities of the series member, the telescopic cylinder, and the fitting member are all through hollow.

Preferably, an upper end surface of the member is movably connected to a bottom end surface of the reinforcing block, so that inner cavities of the rotating mechanism and the auxiliary lifting mechanism are in communication. An outer end surface of the reinforcing arm is mounted on a lower end surface of the supporting inclined column, and the reinforcing arm is a component made of an alloy material. When a user sits on a seat cushion, the weight of the user above the seat cushion provides the gravity downward to the supporting frame, and a distance between the series member and the fitting member is adjusted by using the telescopic cylinder, so that the overall device has a certain degree of buffering, which improves the comfort of the user. By means of the arranged reinforcing arm, when the overall device sinks, the supporting inclined column will bend downward to fit an upper end surface of the reinforcing arm, so as to avoid a damage to the overall structure of the device caused by inability of bearing the weight as the supporting inclined column is excessively deformed due to the excessive weight.

Preferably, the supporting frame includes load-bearing frames, lifting frames, and lazy arms, both ends of the load-bearing frame are provided with the lifting frames, and both ends of the lifting frame are movably provided with the lazy arms.

Preferably, the load-bearing frame includes a supporting cross bar and connecting holes, and the connecting holes are arranged on upper and lower end surfaces of the supporting cross bar, inner cavity walls of the connecting hole and the insertion hole are both provided with threaded structures, and the insertion hole and the connecting hole are thread-fitted by a screw.

Preferably, the lifting frame includes a supporting crossarm and side-opened columns, and edges of both end surfaces of the supporting crossarm are provided with the side-opened columns.

Preferably, the lazy arm 23 includes a first mounting member 231, a suspender 232, and a second mounting member 233, the first mounting member 231 and the second mounting member 233 are connected by the suspender 232, and the first mounting member 231 penetrates into an inner cavity of the side-opened column 222, so that the first mounting member 231 rotates with the side-opened column 222 as a fulcrum. The suspender is pushed such that the suspender rotates with the side-opened column as the fulcrum, so that the lazy arm can swing back and forth as a whole, so as to support a seat cushion at different angles, thus supporting different sitting postures of a user, and avoiding overturning due to the excessively large overall tilt angle of the seat.

3. Beneficial Effects

Compared with the prior art, the advantages of the present invention are:

1. The present invention proposes a multifunctional outdoor leisure rotary chair. The whole device is placed on the flat ground with the ground-contact supporting ring as a supporting point, the supporting frame is mounted on the upper end surface of the carrier sheet, and the carrier sheet rotates with the gas pole as the fulcrum at the rotation angle of 360 degrees.

2. The present invention proposes a multifunctional outdoor leisure rotary chair. When a user sits on a seat cushion, the weight of the user above the seat cushion provides the gravity downward to the supporting frame, and a distance between the series member and the fitting member is adjusted by using the telescopic cylinder, so that the overall device has a certain degree of buffering, which improves the comfort of the user. By means of the arranged reinforcing arm, when the overall device sinks, the supporting inclined column will bend downward to fit an upper end surface of the reinforcing arm, so as to avoid a damage to the overall structure of the device caused by inability of bearing the weight as the supporting inclined column is excessively deformed due to the excessive weight.

3. The present invention proposes a multifunctional outdoor leisure rotary chair. The suspender is pushed such that the suspender rotates with the side-opened column as the fulcrum, so that the lazy arm can swing back and forth as a whole, so as to support a seat cushion at different angles, thus supporting different sitting postures of a user, and avoiding overturning due to the excessively large overall tilt angle of the seat.

4. The present invention proposes a multifunctional outdoor leisure rotary chair. After the supporting frame is taken out, each group of rotary bases can be stacked up in turn, thus reducing the size of a packaging box during packaging. During transportation, more groups can be stacked without affecting packaging and transportation, thereby reducing the cost of packaging materials, reducing the transportation cost, and increasing the transportation capacity of the device.

Figure 1:
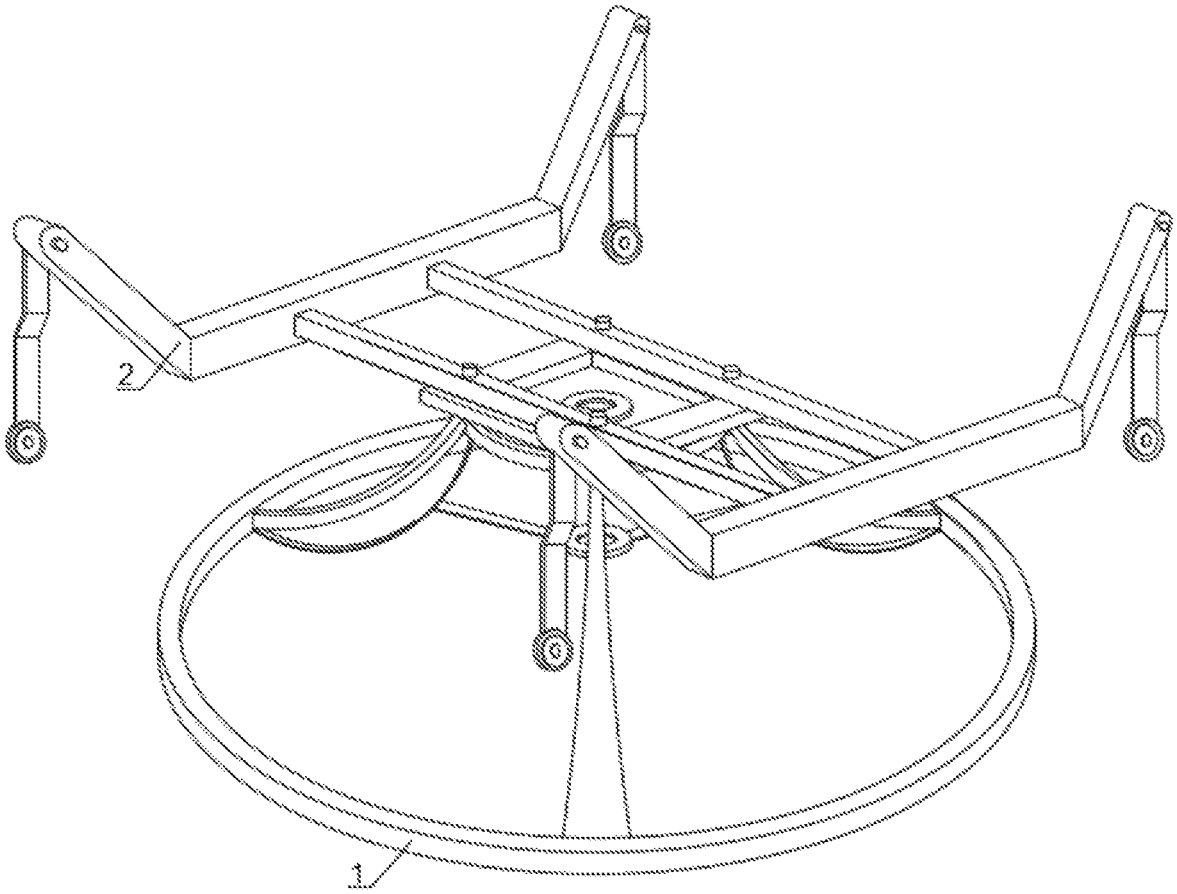
FIG. 1 is a schematic diagram of a connection structure between a rotary base and a supporting frame of a multifunctional outdoor leisure rotary chair according to the present invention.

Description of reference numerals in the drawings: 1. Rotary base; 11. Ground-contact supporting ring; 12. Rotating mechanism; 121. Supporting inclined column; 122. Reinforcing block; 123. Gas pole; 124. Carrier sheet; 125. Insertion hole; 126. Insertion ring; 13. Auxiliary lifting mechanism; 131. Reinforcing arm; 132. Inner connecting rod; 133. Series member; 134. Telescopic cylinder; 135. Fitting member; 2. Supporting frame; 21. Load-bearing frame; 211. Supporting cross bar; 212. Connecting hole; 22. Lifting frame; 221. Supporting crossarm; 222. Side-opened column; 23. Lazy arm; 231. First mounting member; 232. Suspender; and 233. Second mounting member.

DESCRIPTION OF THE EMBODIMENTS

In the description of the present invention, it should be understood that orientations or positional relationships indicated by terms such as "central," "longitudinal," "lateral," "length," "width," "thickness," "upper," "lower," "front," "rear," "left," "right," "vertical," "horizontal," "top," "bottom," "inner," "outer," "clockwise," and "counterclockwise" are based on the orientations or positional relationships shown in the drawings, which are only for the convenience of describing the present invention and simplifying the description, rather than indicating or implying that the indicated apparatuses or elements must have specific orientations, or be constructed and operated in specific orientations, and therefore should not be construed as limitations to the present invention.

In the description of the present invention, "a plurality of" means two or more, unless otherwise expressly and specifically defined.

In the description of the present invention, it should be noted that, unless otherwise expressly specified and limited, terms such as "mounted," "provided with," "sleeve/connect," and "connection" should be understood in a broad sense. For example, a "connection" may be a fixed connection, a detachable connection, or an integral connection; it may be a mechanical connection or an electrical connection; it may be a direct connection or an indirect connection through an intermediate medium, or an internal communication between two elements. For those of ordinary skill in the art, the specific meanings of the above terms in the present invention can be understood in specific situations.

Figure 2:
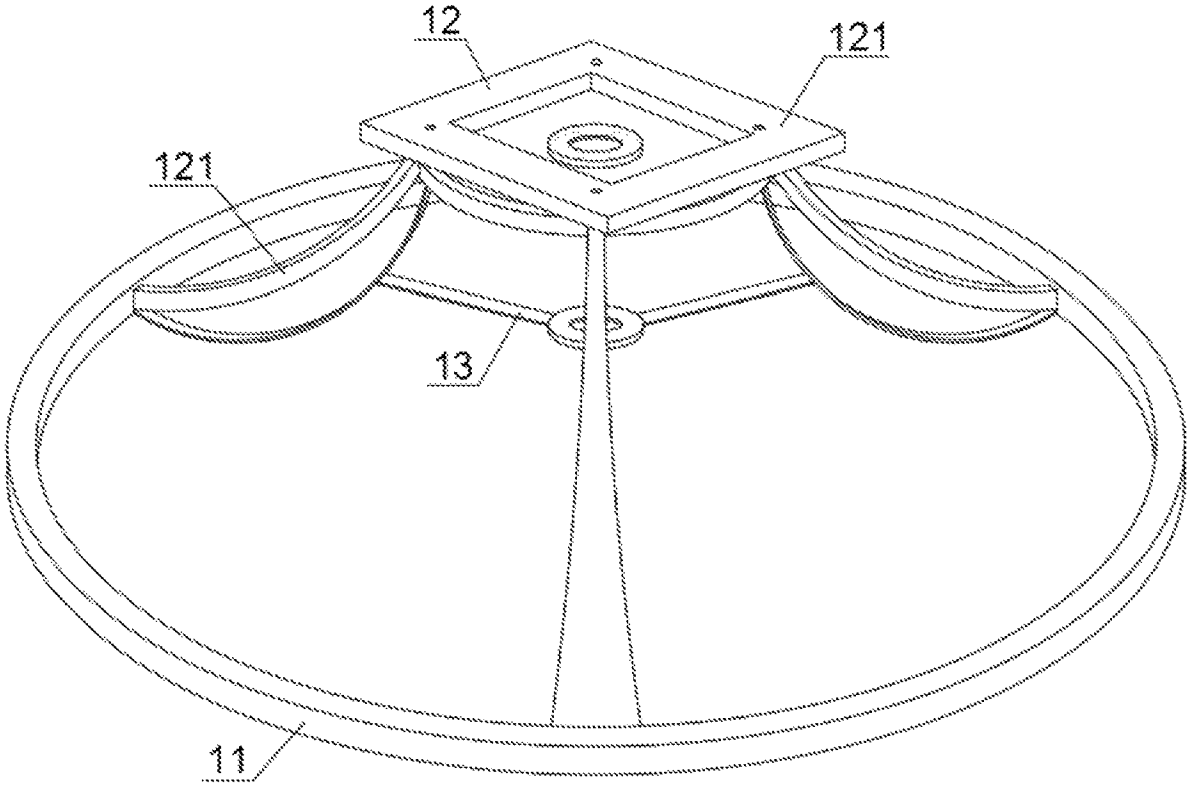
FIG. 2 is a schematic structural diagram of a rotary base of a multifunctional outdoor leisure rotary chair according to the present invention.
Figure 3:
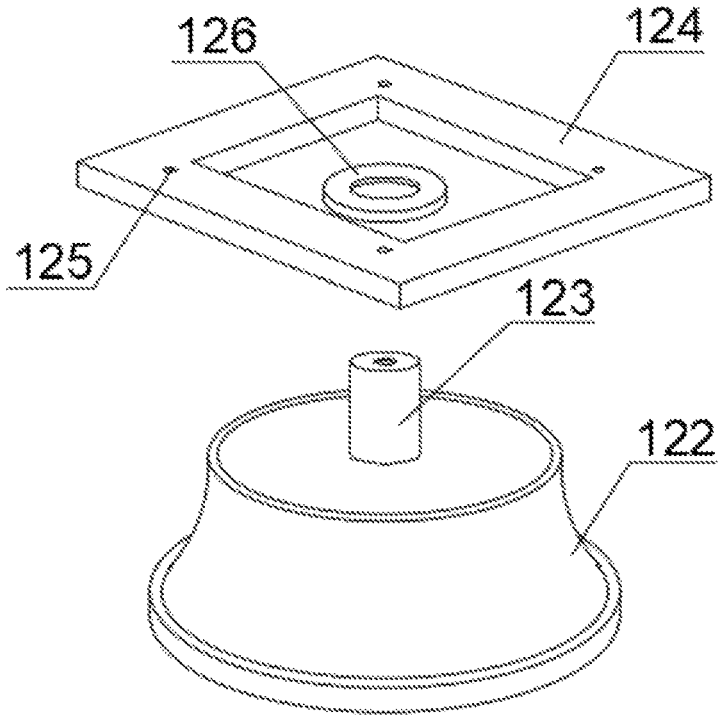
FIG. 3 is a schematic structural diagram of a rotating mechanism of a multifunctional outdoor leisure rotary chair according to the present invention.
Figure 4:
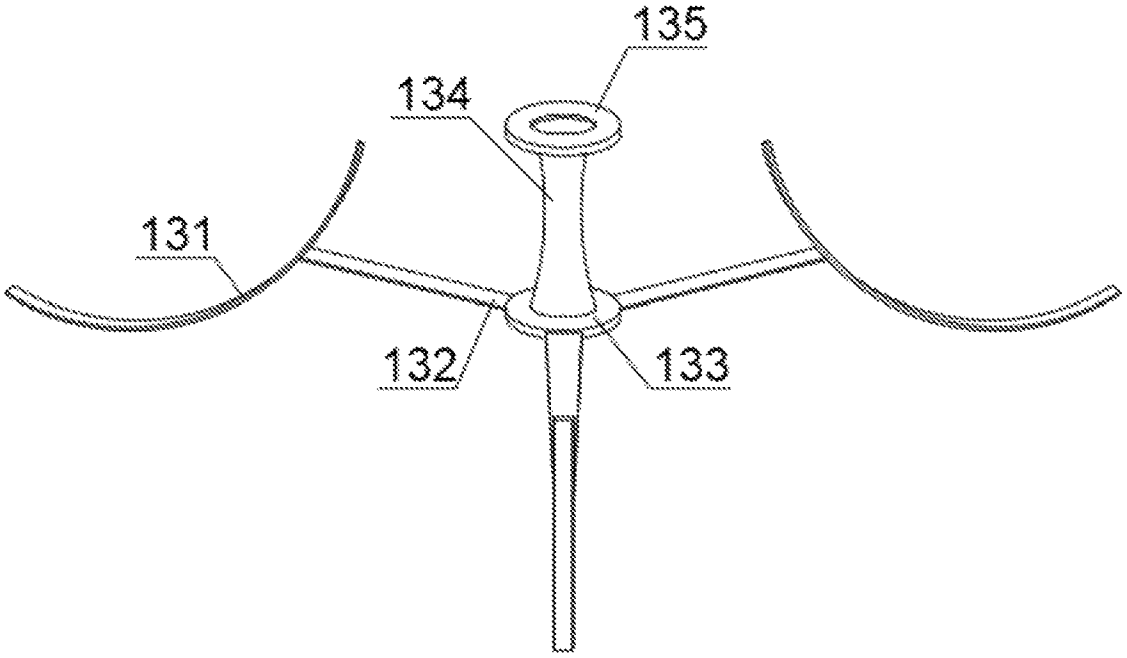
FIG. 4 is a schematic diagram of an auxiliary lifting mechanism of a multifunctional outdoor leisure rotary chair according to the present invention.
Figure 5:
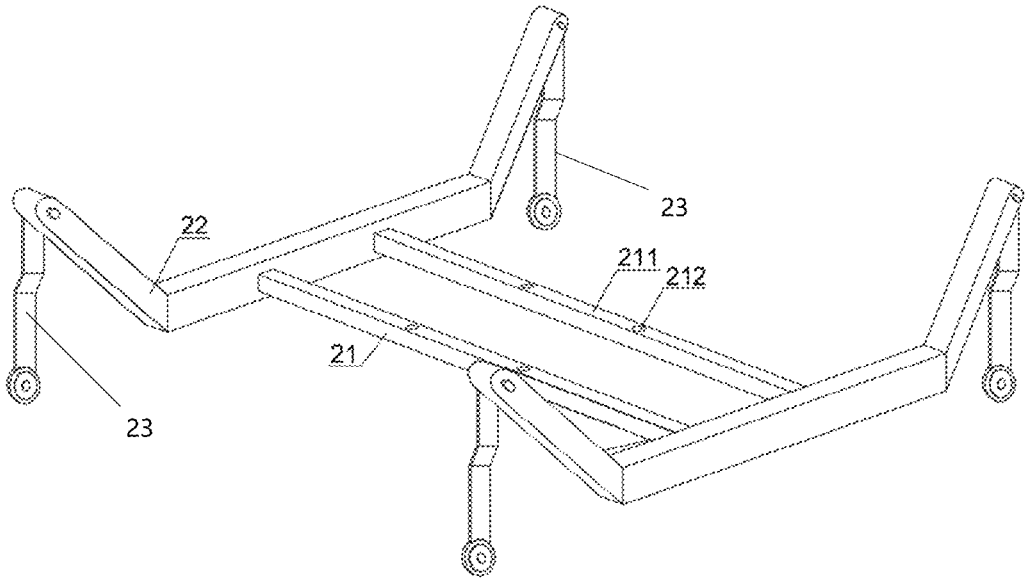
FIG. 5 is a schematic structural diagram of a supporting frame of a multifunctional outdoor leisure rotary chair according to the present invention.
Figure 6:
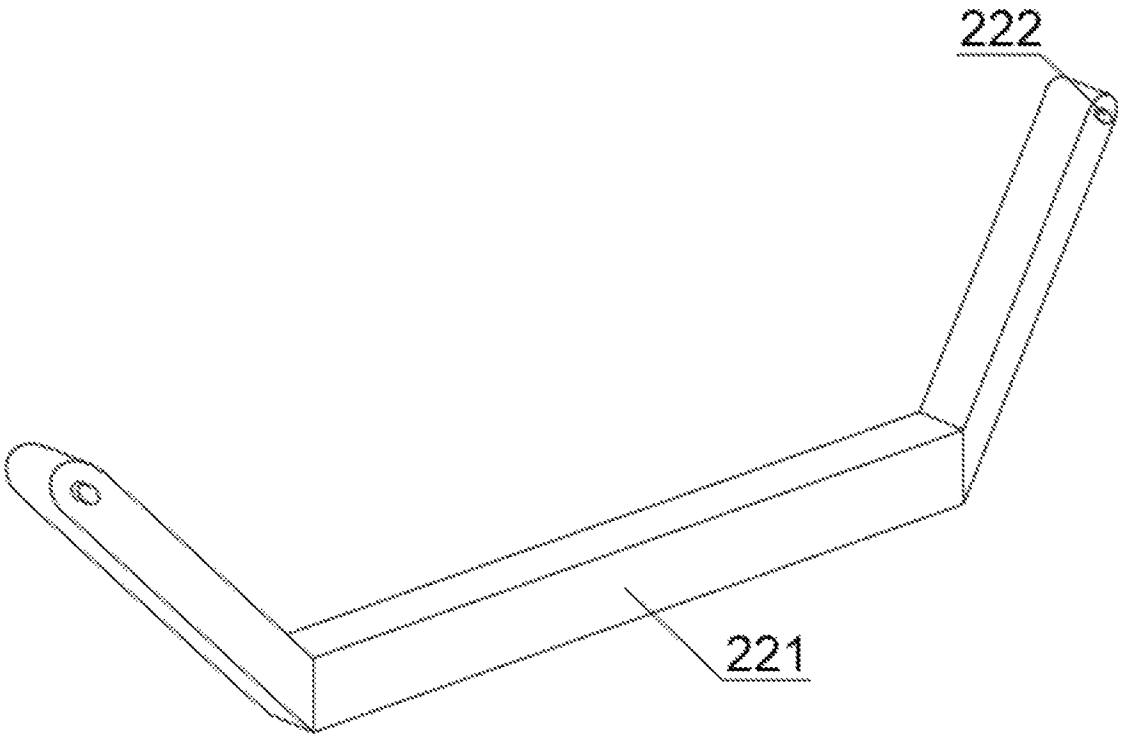
FIG. 6 is a schematic structural diagram of a lifting frame of a multifunctional outdoor leisure rotary chair according to the present invention.
Figure 7:
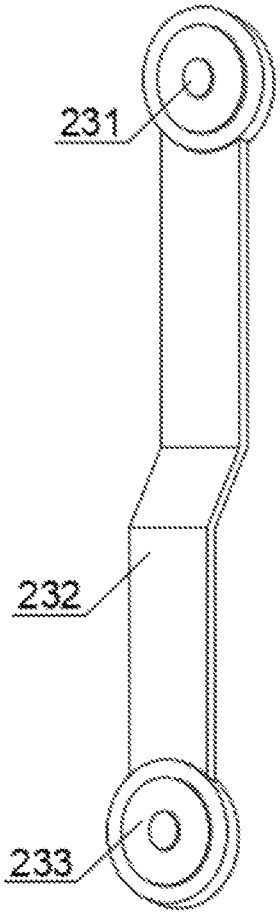
FIG. 7 is a schematic structural diagram of a lazy arm of a multifunctional outdoor leisure rotary chair according to the present invention.

Referring to FIG. 1 to FIG. 7, the present invention provides a technical solution:

A multifunctional outdoor leisure rotary chair includes a rotary base 1 and a supporting frame 2, and the supporting frame 2 being mounted at one end of the rotary base 1, wherein the rotary base 1 includes a ground-contact supporting ring 11, a rotating mechanism 12, and an auxiliary lifting mechanism 13, the rotating mechanism 12 is mounted on an inner end face of the ground-contact supporting ring 11 in an annular array, and the auxiliary lifting mechanism 13 is mounted on a lower end surface of the rotating mechanism 12.

The rotating mechanism 12 includes three groups of supporting inclined columns 121, a reinforcing block 122, and a gas pole 123, the reinforcing block 122 is clamped between the three groups of supporting inclined columns 121, and the gas pole 123 is mounted on the top of the reinforcing block 122.

The rotating mechanism 12 further includes a carrier sheet 124, insertion holes 125, and an insertion ring 126, a top end of the gas pole 123 is inserted into an inner cavity of the insertion ring 126, the insertion holes 125 are arranged on the periphery of the carrier sheet 124, and an inner cavity of the carrier sheet 124 penetrates into an inner cavity wall of the insertion ring 126. The whole device is placed on the flat ground with the ground-contact supporting ring 11 as a supporting point. The supporting frame 2 is mounted on an upper end surface of the carrier sheet 124. The carrier sheet 124 rotates with the gas pole 123 as a fulcrum at a rotation angle of 360 degrees.

The auxiliary lifting mechanism 13 includes three groups of reinforcing arms 131, inner connecting rods 132, a series member 133, a telescopic cylinder 134, and a fitting member 135, inner ends of the three groups of reinforcing arms 131 are all provided with the inner connecting rods 132 mounted thereon, and the other ends of the inner connecting rods 132 are connected to an outer end wall of the series member 133 in an annular array, the series member 133 and the fitting member 135 are movably connected through the telescopic cylinder 134, and inner cavities of the series member 133, the telescopic cylinder 134, and the fitting member 135 are all through hollow.

An upper end surface of the fitting member 135 is movably connected to a bottom end surface of the reinforcing block 122, so that inner cavities of the rotating mechanism 12 and the auxiliary lifting mechanism 13 are in communication. An outer end surface of the reinforcing arm 131 is mounted on a lower end surface of the supporting inclined column 121, and the reinforcing arm 131 is a component made of an alloy material. When a user sits on a seat cushion, the weight of the user above the seat cushion provides the gravity downward to the supporting frame 2, and a distance between the series member 133 and the fitting member 135 is adjusted by using the telescopic cylinder 134, so that the overall device has a certain degree of buffering, which improves the comfort of the user. By means of the arranged reinforcing arm 131, when the overall device sinks, the supporting inclined column 121 will bend downward to fit an upper end surface of the reinforcing arm 131, so as to avoid a damage to the overall structure of the device caused by inability of bearing the weight as the supporting inclined column 121 is excessively deformed due to the excessively large weight.

The supporting frame 2 includes load-bearing frames 21, lifting frames 22, and lazy arms 23, both ends of the load-bearing frame 21 are provided with the lifting frames 22, and both ends of the lifting frame 22 are movably provided with the lazy arms 23.

The load-bearing frame 21 includes a supporting cross bar 211 and connecting holes 212, and the connecting holes 212 are arranged on upper and lower end surfaces of the supporting cross bar 211, inner cavity walls of the connecting hole 212 and the insertion hole 125 are both provided with threaded structures, and the insertion hole 125 and the connecting hole 212 are thread-fitted by a screw.

The lifting frame 22 includes a supporting crossarm 221 and side-opened columns 222, and edges of both end surfaces of the supporting crossarm 221 are provided with the side-opened columns 222.

The lazy arm 23 includes a first mounting member 231, a suspender 232, and a second mounting member 233, the first mounting member 231 and the second mounting member 233 are connected by the suspender 232, and the first mounting member 231 penetrates into an inner cavity of the side-opened column 222, so that the first mounting member 231 rotates with the side-opened column 222 as a fulcrum. The suspender is pushed such that the suspender 232 rotates with the side-opened column 222 as the fulcrum, so that the lazy arm 23 can swing back and forth as a whole, so as to support a seat cushion at different angles, thus supporting different sitting postures of a user, and avoiding overturning due to the excessively large overall tilt angle of the seat.

In addition, the whole device is placed on the flat ground with the ground-contact supporting ring 11 as a supporting point. The supporting frame 2 is mounted on the upper end surface of the carrier sheet 124. The carrier sheet 124 rotates with the gas pole 123 as a fulcrum at a rotation angle of 360 degrees. When a user sits on a seat cushion, the weight of the user above the seat cushion provides the gravity downward to the supporting frame 2, and a distance between the series member 133 and the fitting member 135 is adjusted by using the telescopic cylinder 134, so that the overall device has a certain degree of buffering, which improves the comfort of the user. By means of the arranged reinforcing arm 131, when the overall device sinks, the supporting inclined column 121 will bend downward to fit an upper end surface of the reinforcing arm 131 to avoid a damage to the overall structure of the device caused by inability of bearing the weight as the supporting inclined column 121 is excessively deformed due to the excessively large weight. The suspender 232 is pushed such that the suspender 232 rotates with the side-opened column 222 as the fulcrum, so that the lazy arm 23 can swing back and forth as a whole, so as to support a seat cushion at different angles, thus supporting different sitting postures of a user, and avoiding overturning due to the excessively large overall tilt angle of the seat.

To sum up, a multifunctional outdoor leisure rotary chair includes a rotary base 1 and a supporting frame 2, and the supporting frame 2 is mounted at one end of the rotary base 1. The rotary base 1 includes a ground-contact supporting ring 11, a rotating mechanism 12, and an auxiliary lifting mechanism 13. The rotating mechanism 12 is mounted on an inner end face of the ground-contact supporting ring 11 in an annular array, and the auxiliary lifting mechanism 13 is mounted on a lower end surface of the rotating mechanism 12. The whole device is placed on the flat ground with the ground-contact supporting ring 11 as a supporting point. The supporting frame 2 is mounted on the upper end surface of the carrier sheet 124. The carrier sheet 124 rotates with the gas pole 123 as a fulcrum at a rotation angle of 360 degrees. When a user sits on a seat cushion, the weight of the user above the seat cushion provides the gravity downward to the supporting frame 2, and a distance between the series member 133 and the fitting member 135 is adjusted by using the telescopic cylinder 134, so that the overall device has a certain degree of buffering, which improves the comfort of the user. By means of the arranged reinforcing arm 131, when the overall device sinks, the supporting inclined column 121 will bend downward to fit an upper end surface of the reinforcing arm 131 to avoid a damage to the overall structure of the device caused by inability of bearing the weight as the supporting inclined column 121 is excessively deformed due to the excessively large weight. The suspender 232 is pushed such that the suspender 232 rotates with the side-opened column 222 as the fulcrum, so that the lazy arm 23 can swing back and forth as a whole, so as to support a seat cushion at different angles, thus supporting different sitting postures of a user, and avoiding overturning due to the excessively large overall tilt angle of the seat.

The basic principles, main features, and advantages of the present invention have been shown and described in the foregoing. Those skilled in the art should understand that the present invention is not limited by the above embodiments, and the above embodiments and descriptions are only preferred examples of the present invention, and are not intended to limit the present invention. Under the premise of not departing from the spirit and scope of the present invention, the present invention will also have various changes and improvements, and these changes and improvements all fall within the claimed scope of the present invention. The claimed scope of the present invention is defined by the appended claims and their equivalents.

What is claimed is:

1. A multifunctional outdoor leisure rotary chair, comprising a rotary base (1) and a supporting frame (2), and the supporting frame (2) being mounted at one end of the rotary base (1), wherein the rotary base (1) comprises a ground-contact supporting ring (11), a rotating mechanism (12), and an auxiliary lifting mechanism (13), the rotating mechanism (12) is mounted on an inner end face of the ground-contact supporting ring (11) in an annular array, and the auxiliary lifting mechanism (13) is mounted on a lower end surface of the rotating mechanism (12);

wherein the auxiliary lifting mechanism (13) comprises three groups of reinforcing arms (131), inner connecting rods (132), a series member (133), a telescopic cylinder (134), and a fitting member (135), inner ends of the three groups of reinforcing arms (131) are all provided with the inner connecting rods (132) mounted thereon, and the other ends of the inner connecting rods (132) are connected to an outer end wall of the series member (133) in an annular array, the series member (133) and the fitting member (135) are movably connected through the telescopic cylinder (134), and the series member (133), the telescopic cylinder (134), and the fitting member (135) are hollow.

2. The multifunctional outdoor leisure rotary chair according to claim 1, wherein the rotating mechanism (12) comprises three groups of supporting inclined columns (121), a reinforcing block (122), and a gas pole (123), the reinforcing block (122) is clamped between the three groups of supporting inclined columns (121), and the gas pole (123) is mounted on a top of the reinforcing block (122).

3. The multifunctional outdoor leisure rotary chair according to claim 1, wherein the rotating mechanism (12) further comprises a carrier sheet (124), insertion holes (125), and an insertion ring (126), a top end of the gas pole (123) is inserted into an inner cavity of the insertion ring (126), the insertion holes (125) are arranged on the periphery of the carrier sheet (124), and an inner cavity of the carrier sheet (124) penetrates into an inner cavity wall of the insertion ring (126).

4. The multifunctional outdoor leisure rotary chair according to claim 1, wherein an upper end surface of the fitting member (135) is movably connected to a bottom end surface of the reinforcing block (122), so that inner cavities of the rotating mechanism (12) and the auxiliary lifting mechanism (13) are in communication.

5. The multifunctional outdoor leisure rotary chair according to claim 1, wherein an outer end surface of the reinforcing arm (131) is mounted on a lower end surface of the supporting inclined column (121), and the reinforcing arm (131) is a component made of an alloy material.

6. The multifunctional outdoor leisure rotary chair according to claim 1, wherein the supporting frame (2) comprises load-bearing frames (21), lifting frames (22), and lazy arms (23), both ends of the load-bearing frame (21) are provided with the lifting frames (22), and both ends of the lifting frame (22) are movably provided with the lazy arms (23).

7. A base structure of the leisure rotary chair according to claim 6, wherein the load-bearing frame (21) comprises a supporting cross bar (211) and connecting holes (212), and the connecting holes (212) are arranged on upper and lower end surfaces of the supporting cross bar (211), inner cavity walls of the connecting hole (212) and the insertion hole (125) are both provided with threaded structures, and the insertion hole (125) and the connecting hole (212) are thread-fitted by a screw.

8. The base structure of the leisure rotary chair according to claim 6, wherein the lifting frame (22) comprises a supporting crossarm (221) and side-opened columns (222), and edges of both end surfaces of the supporting crossarm (221) are provided with the side-opened columns (222).

9. The base structure of the leisure rotary chair according to claim 6, wherein each of the lazy arms (23) comprises a first mounting member (231), a suspender (232), and a second mounting member (233), the first mounting member (231) and the second mounting member (233) are connected by the suspender (232), and the first mounting member (231) penetrates into an inner cavity of a corresponding side-opened column (222), so that the first mounting member (231) rotates with the corresponding side-opened column (222) as a fulcrum.

* * * * *